United States Patent [19]

Romanauskas

[11] 4,398,905

[45] Aug. 16, 1983

[54] VARIABLE PRESSURE ROTOR

[75] Inventor: William A. Romanauskas, Southbury, Conn.

[73] Assignee: E. I. Du Pont de Nemours and Company, Wilmington, Del.

[21] Appl. No.: 424,475

[22] Filed: Sep. 27, 1982

[51] Int. Cl.[3] ..... B04B 9/12

[52] U.S. Cl. ..... 494/16

[58] Field of Search ..... 494/16, 17, 21, 45

[56] References Cited

U.S. PATENT DOCUMENTS 3,366,320 1/1968 Cho ..... 494/16

4,166,573 9/1979 Webster ..... 494/21

4,327,661 5/1982 Boeckel ..... 494/16 X

*Primary Examiner*—Harvey C. Hornsby

*Assistant Examiner*—Shewen Bian

[57] ABSTRACT

A fixed angle centrifuge rotor having a cavity is provided with a well adapted to receive a predetermined volume of a liquid having a predetermined specific gravity. The well is interconnected with the cavity by a substantially radially extending passageway such that when the rotor is rotated liquid moves from the well into the cavity to surround a container having a sample therein to thereby increase the hydrostatic pressure exerted on the sample.

9 Claims, 3 Drawing Figures

VARIABLE PRESSURE ROTOR

BACKGROUND OF THE INVENTION

This invention relates to a centrifuge rotor and, in particular, to a centrifuge rotor having an arrangement whereby the pressure to which a sample to be centrifuged is exposed may be varied.

It has been observed that when using a vertical tube rotor for self-generating gradient separations, such as that disclosed in U.S. Pat. No. 3,998,383 (Romanauskas et al.), banding of particles occurs at densities which differ from the densities at which the same particles band when the self-generating gradient separation is performed on a swinging bucket or fixed angle rotor. This discrepancy is believed to be caused by differences in the hydrostatic pressure or compressability force exerted on particles when centrifuged in a vertical tube rotor as opposed to other rotors.

Accordingly, it is believed to be advantageous to provide a mechanism whereby the compressability force exerted on the particles being separated when using a vertical tube rotor be made to be substantially equal to the hydrostatic compressability force exerted on particles when separated in another type centrifuge rotor so that banding of particles occurs at corresponding densities. More broadly speaking, it is believed to be advantageous to provide a centrifuge rotor of the fixed angle type wherein a mechanism is provided for adjusting the hydrostatic pressure to which particles in suspension are exposed so that the pressure effects on samples may be determined. As a corollary to the foregoing, it is believed to be of further advantage to provide a rotor of the fixed angle type wherein pressure effects on the particles over a range of ambient pressures may be observed using only a single run.

SUMMARY OF THE INVENTION

In accordance with the present invention a fixed angle rotor of the type having at least one cavity adapted to receive a sample-carrying container therein includes a well for receiving a predetermined volume of a liquid having a predetermined specific gravity. The well is disposed in the rotor radially inwardly of the cavity with a passage interconnecting the well and the cavity. When the predetermined volume of the liquid having a predetermined specific gravity is introduced into the well and the rotor is rotated the liquid moves under the influence of centrifugal force from the well through the passage into the cavity to surround a container disposed therein and increase the hydrostatic pressure exerted on the sample in the container. In the preferred embodiment the rotor has a plurality of container-receiving cavities each of which may be provided with a corresponding well and interconnecting passage. As an alternative embodiment it is within the contemplation of this invention to provide a single communal well interconnected by a passage with each respective one of the container-receiving cavities disposed about the periphery of the rotor.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figure 1:
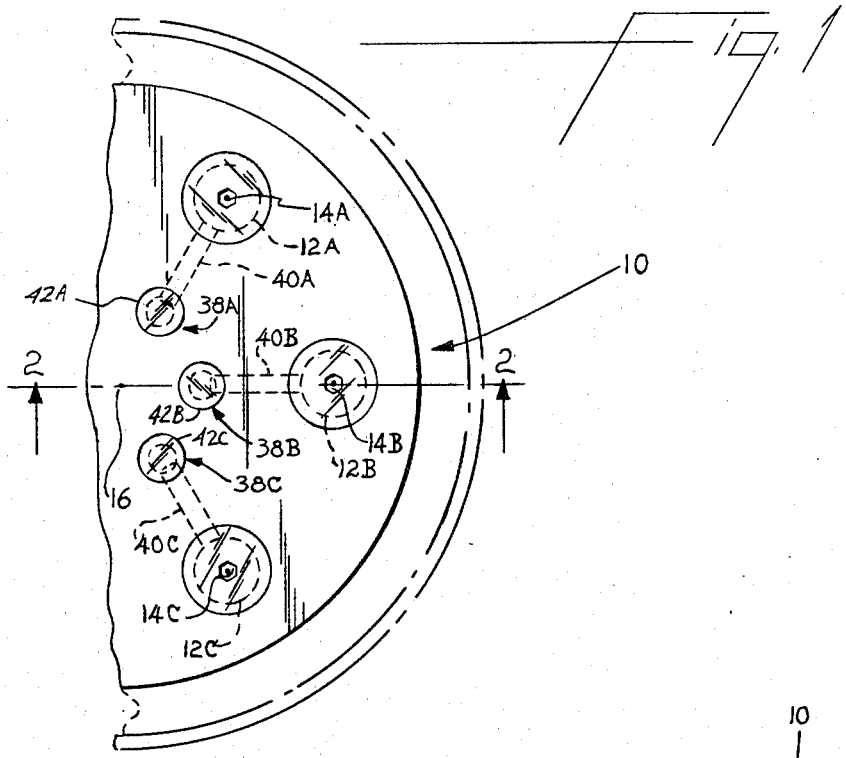
FIG. 1 is a plan view of a portion of a centrifuge rotor apparatus having a variable pressure producing arrangement in accordance with the present invention disposed therein.

Throughout the following detailed description similar reference numerals refer to similar elements in all figures of the drawings.

Figure 2:
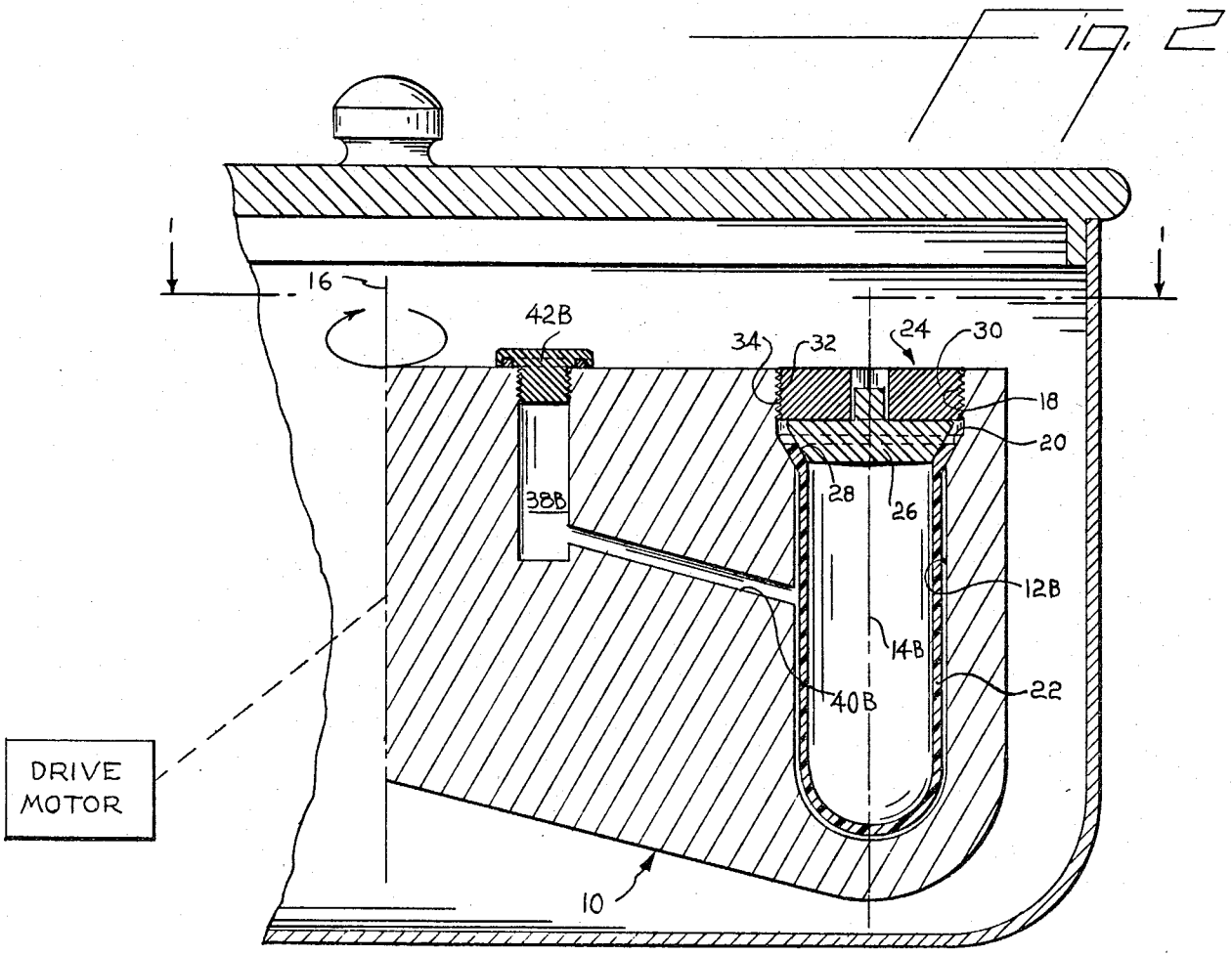
FIG. 2 is a sectional view taken along section lines 2—2 of FIG. 1.

As seen in FIGS. 1 and 2 a fixed angle centrifuge rotor apparatus generally indicated by reference character 10 is provided with an array of sample container-receiving cavities 12. The cavities, three of which are indicated by reference characters 12A, 12B and 12C, are equiangularly disposed about the periphery of the rotor 10. The axis 14 of each of the cavities 12 is arranged to lie substantially parallel to the axis of rotation 16 of the rotor 10 in a manner described in U.S. Pat. No. 3,998,383 (Romanauskas et al.) assigned to the assignee of the present invention. Although the rotor illustrated in the Figures is of the vertical tube type (i.e., the fixed angle is equal to zero), it is to be understood that the invention is also applicable to nonvertical tube fixed angle rotors. The upper end of each cavity 12 is counterbored, as at 18 (FIG. 2), and a flared surface 20 is defined between the cavity 12 and the counterbore 18. Motive force for the rotor 10 is provided by a drive motor mechanically linked to the rotor in any convenient manner. (The mechanical linkage is schematically shown by the dashed line interconnecting the drive motor and the rotor 10.)

Each cavity 12 is adapted to receive, with a small clearance, a container 22 carrying a sample which includes a supernatant with particulate matter in suspension therein. It is desired that the particulate matter be separated using the density gradient separation technique. To effect this purpose a container 22 is inserted into one of the cavities 12 and an appropriate capping mechanism, generally indicated by character 24, is provided to seal the open top of the container. The capping mechanism includes a plug 26 having a flared peripheral portion 28 disposed thereon. A cap 30 having exterior threads 32 is arranged to be interconnected with threads 34 provided in a counterbored portion 18 of the cavity 12. When disposed in the above-described assembled relationship (as shown in FIG. 2) the plug 26 is urged downwardly such that a radially outwardly directed force urges the open end of the container 12 against the flared surface 20 above the cavity 12.

Figure 3:
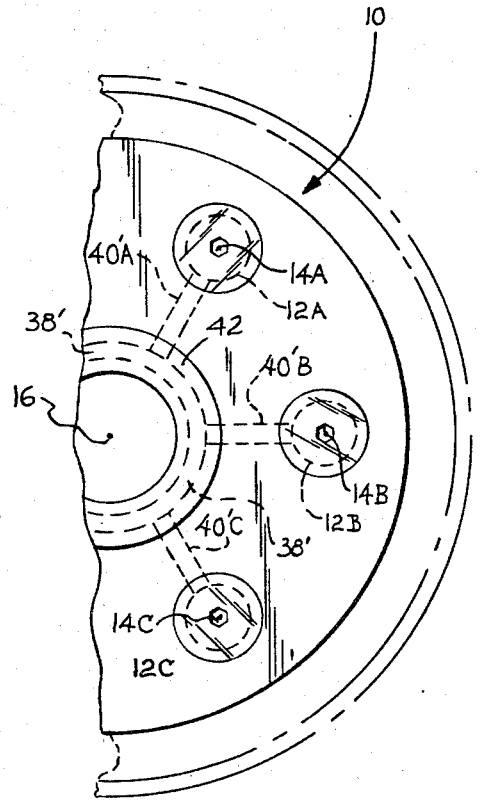
FIG. 3 is a plan view generally similar to FIG. 1 illustrating an alternative embodiment of the present invention.

In accordance with one embodiment of the present invention (FIGS. 1 and 2) a well 38 is disposed radially inwardly of each of the cavities 12. Each well 38 is interconnected with its corresponding cavity 12 by a substantially radially extending passageway 40. The location, depth and inclination of the passageway 40 interconnecting the well 38 with its associated cavity may be conveniently selected for ease of manufacture or for other considerations. In an alternate embodiment of the invention shown in FIG. 3 an annular communal well 38' is shown disposed radially inwardly of the array of cavities 12. The communal well 38' is interconnected with each of the cavities by a plurality of radially outwardly extending passages 40'. In either embodiment of the invention the individual wells 38 or the communal well 38' is sealed at the mouth by an appropriately threaded cap 42 or any other suitable mechanism.

In operation, a predetermined volume of a liquid having a predetermined specific gravity is introduced into the well 38 or 38'. The liquid responds to centrifugal force by moving radially outwardly through the passages 40 and surrounds the sample container disposed in each cavity 12 to pressurize the container 22 disposed within the cavity 12. The magnitude of the pressure exerted on the container is functionally related to the volume and to the specific gravity of the liquid introduced into the well. If it is desired to ascertain the effects of pressure differences over a wide range of pressures the embodiment of the rotor disclosed in FIGS. 1 and 2 is preferred inasmuch as various pressure conditions may be generated within various ones of the cavities 12 by appropriately selecting the volume, or the specific gravity, or both, of the liquid introduced into the well 38 corresponding to that cavity.

Those skilled in the art having the benefit of the teachings of the present invention as hereinabove set forth may effect numerous modifications thereto. These modifications are to be construed as lying within the scope of the present invention as disclosed in the appended claims.

What is claimed is:

1. In a centrifuge rotor of the type having a cavity adapted to receive a sample-carrying container therein, the improvement which comprises:

a well adapted to receive a predetermined volume of a liquid having a predetermined specific gravity, the well being disposed in the rotor at a location radially inwardly of the cavity; and a passage interconnecting the well with the cavity such that when a predetermined volume of a liquid having a predetermined specific gravity is introduced into the well and the rotor is rotated, liquid moves under the influence of centrifugal force from the well through the passage and into the cavity to surround a container disposed therein and increase the hydrostatic pressure exerted on a sample carried in the container.

2. The centrifuge rotor of claim 1 further comprising a cap receivable at the mouth of the well.

3. The centrifuge rotor of claims 1 or 2 wherein the axis of the cavity is substantially parallel to the axis of rotation of the rotor.

4. In a centrifuge rotor of the fixed angle type having a plurality of cavities equiangularly disposed about the periphery thereof, each cavity being adapted to receive a sample-carrying container therein, the improvement which comprises:

a plurality of wells arrayed in the rotor radially inwardly of the cavities, one of the wells being respectively associated with one of the cavities, each well being adapted to receive a predetermined volume of a liquid having a predetermined specific gravity; and a plurality of passages disposed in the rotor to interconnect each well with its associated cavity such that when a predetermined volume of a liquid having a predetermined specific gravity is introduced into a well and the rotor is rotated, liquid moves under the influence of centrifugal force from the well through the passage and into the cavity to surround a container disposed therein and increase the hydrostatic pressure on a sample carried in the container.

5. The centrifuge rotor of claim 4 further comprising a cap receivable at the mouth of each well.

6. The centrifuge rotor of claims 4 or 5 wherein the axis of each cavity is substantially parallel to the axis of rotation of the rotor.

7. In a centrifuge rotor of the type having a plurality of cavities disposed equiangularly about the rotor, each cavity being adapted to receive a sample-carrying container therein, the improvement which comprises:

a communal well adapted to receive a predetermined volume of a liquid having a predetermined specific gravity, the well being disposed in the rotor radially inwardly of the cavities; and a plurality of passages adapted to interconnect the well with each of the cavities so that when a predetermined volume of a liquid having a predetermined specific gravity is introduced into the well and the rotor is rotated liquid moves under the influence of centrifugal force from the well through the passages and into the cavities to surround a container disposed in a cavity and increase the hydrostatic pressure exerted on a sample carried in the container.

8. The centrifuge rotor of claim 7 further comprising a cap receivable at the mouth of the well.

9. The centrifuge rotor of claims 7 or 8 wherein the axis of each cavity is substantially parallel to the axis of the rotor.

* * * * *